US005993297A

United States Patent [19]

Hyatt et al.

[11] Patent Number: 5,993,297

[45] **Date of Patent: *Nov. 30, 1999**

[54] SUPERABRASIVE GRINDING WHEEL WITH INTEGRAL COOLANT PASSAGE

[75] Inventors: Gregory Aaron Hyatt, Westchester; Andrew Lapham Voss, Cincinnati, both of Ohio

[73] Assignee: Makino Inc., Mason, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/761,959

[22] Filed: Dec. 9, 1996

Related U.S. Application Data

[63] Continuation-in-part of application No. 08/301,197, Sep. 6, 1994, abandoned.

[51] Int. Cl.[6] ..... B24B 55/02

[52] U.S. Cl. ..... 451/53; 451/450; 451/541

[58] Field of Search ..... 451/450, 488, 451/541, 178, 53

[56] References Cited

U.S. PATENT DOCUMENTS

| | | | |
|---|---|---|---|
| 524,572 | 8/1894 | Beckert . | |
| 796,466 | 8/1905 | Stoltzenberg . | |
| 1,396,123 | 11/1921 | Joseph . | |
| 2,455,597 | 12/1948 | Metzger et al. . | |
| 2,626,493 | 8/1953 | Speicher . | |
| 2,815,435 | 12/1957 | Adcock . | |
| 3,144,739 | 8/1964 | Brutvan et al. . | |
| 3,153,885 | 10/1964 | Keller et al. . | |
| 3,233,369 | 2/1966 | Highberg . | |
| 3,282,263 | 11/1966 | Christensen et al. . | |
| 3,345,281 | 10/1967 | Falls . | |
| 3,579,817 | 5/1971 | Whalley | 407/30 |
| 3,609,931 | 10/1971 | Voorhies | 451/450 |
| 3,777,443 | 12/1973 | Shaw . | |
| 4,624,237 | 11/1986 | Inoue . | |
| 4,625,707 | 12/1986 | Whittaker . | |
| 4,854,087 | 8/1989 | Riha | 451/450 |
| 4,944,638 | 7/1990 | Brohammer | 408/59 |
| 5,259,148 | 11/1993 | Wiand . | |

FOREIGN PATENT DOCUMENTS

| | | | |
|---|---|---|---|
| 1715564 | 2/1992 | Russian Federation | 451/450 |

OTHER PUBLICATIONS

Alan C. Carius, *Effects of Grinding Fluid type and Delivery on CBN Wheel Performance* (Oct. 10–12, 1989).

*Primary Examiner*—Robert A. Rose
*Attorney, Agent, or Firm*—Dinsmore & Shohl LLP

[57] ABSTRACT

A grinding tool for use with an automatic tool changing system in conjunction with a machine spindle and a source of cutting fluid. A preferred embodiment of the grinding tool includes a tool holder adapted for attaching the grinding tool to a machine spindle, and an attachment structure for placing the grinding tool in fluid communication with a source of pressurized fluid. The grinding tool further can comprise a fluid distribution passageway having a central supply tube formed within the tool holder, an annular space and guide channels formed within the body of the grinding wheel, and a plurality of non-perpendicular fluid delivery openings formed in the grinding surface so that coolant fluids at pressures of 200 psi and greater can be received within the fluid distribution passageway and delivered in a controlled manner toward the grinding surface via the delivery openings for either cleaning the grinding surface, for cooling and otherwise lubricating the workpiece and the grinding tool, or both.

28 Claims, 7 Drawing Sheets

SUPERABRASIVE GRINDING WHEEL WITH INTEGRAL COOLANT PASSAGE

REFERENCE TO COPENDING APPLICATION

This is a Continuation-in-Part of prior application Ser. No. 08/301,197, filed Sep. 6, 1994 now abandoned.

TECHNICAL FIELD OF THE INVENTION

This invention relates generally to superabrasive grinding wheel tools, and more particularly to a superabrasive grinding wheel tool with an integral passage configured therein to deliver pressurized fluid to the outer periphery of the superabrasive grinding wheel to clean the grinding surface and to cool the wheel and/or the workpiece.

BACKGROUND OF THE INVENTION

It is common in the machine tool industry to use superabrasive grinding wheels to shape and finish workpieces, and more specifically to grind inner and outer diameters of openings and bores, or to contour the surface of a workpiece. The term "grinding" will be used generally herein to describe any of the variety of processes for shaping and finishing parts, including polishing, working, lapping, grinding, contouring or otherwise finishing a workpiece surface. In almost all machine tool operations, the friction between the tool and workpiece generates tremendous amounts of heat energy (which can reach temperatures of about 2000° F. or 1100° C. and above) which if left uncontrolled, could severely damage (e.g., cracking or fracturing) the tool, thus reducing its tool life, making machine tool operations more dangerous and expensive, and reducing the quality and precision of the workmanship. In addition, heat generated friction can discolor the workpiece, and can damage or remove temper or heat treatment on the workpiece. It is commonly known in the industry that coolant can be introduced to the grinding area, such as by spraying, to reduce friction between the tool and workpiece by keeping a thin film of coolant fluid between the grinding wheel and workpiece, and also to help remove energy generated in machine tool operations.

Even though coolant fluid can be supplied to the grinding area, it is often difficult to insure that such fluid actually makes its way to the interstices between the tool and the workpiece, and fluid tends to quickly evaporate due to the high temperatures involved in grinding operation. Thus, large volumes of coolant fluid must generally be continuously supplied to the grinding area for the grinding wheel to operate effectively. This need to keep a thin continuous film of coolant fluid between the grinding wheel and workpiece becomes even more problematic in operations where coolant fluids cannot be introduced in close proximity to the grinding areas while the grinding wheel is engaged with a workpiece due to, for example, the depth of the grinding action in the workpiece.

During use, the grinding surfaces of tools such as grinders can become loaded (e.g., plated or plasticized) with particles from the workpiece, which in turn, reduces the effectiveness of the tool through deteriorating grinding ability, scratching of a workpiece, and even clogging of conventional coolant fluid supply openings. It is obviously preferred that the potential for this undesired loading of particles be reduced, and that any loaded particles be removed from the grinding wheel as quickly as possible. Typically, nozzle arrangements, such as an external cleaning jets, are provided independent of the tool, for injecting coolant fluid at increased velocities toward the grinding surface to wash away particles, to remove plasticized particles already formed on the work surface, and to cool the grinding wheel and workpiece. As mentioned before, it is often very difficult to insure that the fluid sprayed in this way actually reaches the most critical areas of the tool/workpiece interface.

Previously, attempts to address these two simultaneous requirements of cooling the grinding wheel and workpiece and cleaning the grinding wheel have tended to also reduce the flexibility and utility of a machine tool. For example, deep cuts, such as undertaken in creep feed grinding, are difficult to make as coolant delivery to the grinding area is generally limited by the volume of coolant fluid which can be supplied by spraying techniques to the grinding area, and as a result, plasticizing of particles on the grinding wheel as well as heat generated by friction often reduces a tool's effectiveness.

One attempt to more effectively cool tools and hard abrasive workpieces is disclosed in U.S. Pat. No. 3,233,369 to Highberg, where coolant fluid is directed from an external source into an enclosed vertical passageway of a spindle. Fluid is then discharged onto the work surface through orifices adjacent to the inner cutting edge and/or through the center of the tool. Highberg relies primarily on gravity and centrifugal forces (as opposed to high pressure) to deliver coolant fluid through the orifices to the cutting edge. There are, at least, several outstanding shortcomings in the contemplated Highberg system. First, the tool would appear to be primarily limited to a vertical orientation because of the gravitational fluid delivery mechanism, thereby limiting its application and adaptability. Secondly, it is believed that coolant fluid will generally not be delivered in such an arrangement at a sufficient velocity to clean the grinding edges of a superabrasive wheel while in use. As a result, Highberg would not provide a flexible superabrasive grinding system that can provide unrestricted tool paths. Highberg also requires the use of one or more external nozzle jets to provide a fluid spray and remove loaded particles from the superabrasive grinding wheel. Because the use of external jets of this type generally requires alignment procedures to apply coolant at the appropriate angle and location, adjustments and other timely reconfiguration procedures of the coolant supply system would be required when the tool configuration and/or tool path is varied.

Another attempt to improve grinding wheels is described in U.S. Pat. No. 3,244,739, to Brutvan et al. In this device, coolant fluid is supplied from the center of the wheel to the outer grinding edge through guide channels and onto the workpiece via centrifugal force to the point of contact with the grinding wheel. By having an integral, and allegedly even and continuous flow of coolant fluid over the cutting edge, small workpiece particles are to be washed away, and particle build up is theoretically avoided. Brutvan, et al. contemplates that overheating is addressed by the coolant flow equalizing the temperature over the entire workpiece which presumably allows for deeper and heavier cuts to be made. Although Brutvan is designed to wash away particles, its arrangement does not appear to supply coolant fluid at sufficient velocity (i.e., under high enough pressure) to prevent or remove loaded particles on a superabrasive grinding wheel. As mentioned above, the operational speeds and higher temperatures of superabrasive grinding operations tend to overwhelm the centrifugal force application of coolant fluid. Additionally, the machine tool in Brutvan appears to be more suited for a dedicated operation or fixed to a machine, and would not appear to be easily adaptable in a tool holder used with an automatic or quick tool changing system. Again, external nozzle jets for additional coolant delivery would most likely have to be used with the tool shown in Brutvan et al. to help reduce the possibility of plasticizing or plating of particles, and to remove the already loaded particles.

Other attempts to deliver coolant fluid to the grinding area have used air or other pneumatic carriers. As with externally applied liquid coolants, when pneumatic carriers are used, however, turbulence can hinder the grinding operations and often fluid cannot infiltrate into the actual grinding areas.

As can be seen, currently available grinding tools have a number of shortcomings which greatly reduce the ability to use these tools with automatic tool changing systems. Moreover, superabrasive grinding wheels generally operate at increased rotational speeds which result in increased temperatures being generated and increased pressure being exerted on the workpiece by the wheel. A wheel operating under these conditions generally requires additional external coolant fluid supplies or jets to reduce or remove loaded particles from the grinding wheel or to cool the workpiece and grinding wheel. The industry currently lacks a superabrasive grinding tool configured to allow for use of the tool in a wide range of operations (i.e., grinding the inner or outer diameter of a workpiece or face grinding) utilizing a variety of tool paths and which can be used in a quick change machine tool center while also allowing for efficient and enhanced deep precision grinding.

SUMMARY OF THE INVENTION

It is an object of the present invention to provide a superabrasive grinding wheel that addresses and overcomes the above-mentioned problems and shortcomings in the machine tool industry.

It is also an object of the present invention to provide a superabrasive grinding wheel that eliminates the need for external coolant fluid jets for cleaning or removing loaded particles from the tool's grinding surface during use.

It is another object of the present invention to provide an improved superabrasive grinding wheel for use in creep feed grinding operations.

It is still another object of the present invention to provide a superabrasive grinding wheel wherein coolant fluid delivery to the grinding area is not inhibited while the grinding wheel is engaged with a workpiece.

Another object of the present invention is to provide an adaptive superabrasive grinding wheel that can be utilized in a number of grinding operations, (i.e., grinding of outer and/or inner diameters of workpieces, and/or face grinding), and can be operated in variety of tool path operations without requiring machine reconfiguration or significant tooling or coolant supply changes.

It is an object of the present invention to provide an improved performance superabrasive grinding wheel that can be used with a quickly or automatic changeable tool system.

It is also an object of the present invention to provide an improved performance superabrasive grinding wheel that continuously, selectively, and controllably delivers coolant fluid to the grinding area regardless of the type of tool engagement.

It is still a further object of the present invention to provide a superabrasive grinding wheel suited for high angular acceleration with minimum wheel deformation, and optimum cutting and tool maintenance characteristics.

Another object of the present invention is to provide a superabrasive grinding wheel that delivers coolant fluid to the workpiece from the working faces of the wheel.

Additional objects, advantages and other features of the invention will be set forth and will become apparent to those skilled in the art upon examination of the following, or may be learned with practice of the invention.

To achieve the foregoing and other objects, and in accordance with the purpose herein, the present invention comprises a tool for use with an automatic tool changing system in conjunction with a machine spindle and a source of coolant fluid. The tool of the present invention is illustrated as a grinding tool which preferably comprises a tool holder adapted or configured for attaching the grinding tool to a machine spindle, and a connection configured for placing the grinding tool in fluid communication with the source of fluid. Fluid communication can be established by sealingly interfacing the spindle passage and the fluid distribution passageway. The grinding tool further comprises a fluid distribution passageway having a supply tube formed within the tool holder, a plenum, one or more guide channels extending from the plenum and formed within the body of the grinding wheel, and a plurality of non-perpendicularly oriented fluid delivery openings formed in close proximity to the grinding surface for either efficiently cooling the workpiece and tool, for cleaning or otherwise removing plasticized particles from the grinding surface, or both.

In a preferred embodiment, some of the fluid delivery openings can be oriented rearwardly to deliver pressurized coolant fluid to "clean" the tool (i.e., wash away recently cut particles or remove loaded particles from the grinding surface). In such an embodiment, the fluid delivery openings are each preferably oriented at an angle greater than 90 degrees respective to the radial face of the tool. Some fluid delivery openings can also be oriented to simultaneously deliver coolant fluid forward for lubricating and reducing friction between the grinding wheel and workpiece and for cooling the grinding wheel and workpiece. In such an embodiment, the fluid delivery openings are preferably each oriented at an angle less than 90 degrees respective to the radial face of the tool. Certain embodiments prefer that a portion of said fluid delivery openings be oriented rearwardly to deliver pressurized coolant fluids to adequately "clean" the grinding wheel, while a portion of the fluid delivery openings be oriented forwardly to adequately reduce friction between the grinding wheel and the workpiece, and to adequately cool the grinding wheel and a workpiece.

In use, pressurized coolant fluids can be received within the fluid distribution passageway and delivered in a controlled manner to the delivery openings at predetermined pressures. Fluid can be directed through the non-perpendicular openings rearwardly toward a grinding surface/workpiece interface for cleaning the tool, forwardly toward a grinding surface workpiece interface for lubricating the interface and cooling the tool and workpiece, or both.

BRIEF DESCRIPTION OF THE DRAWINGS

While the specification concludes with claims particularly pointing and distinctly claiming the present invention, it is believed the same will be better understood from the following description taken in conjunction with the accompanying drawings in which:

DETAILED DESCRIPTION OF PREFERRED EMBODIMENT

Figure 1:
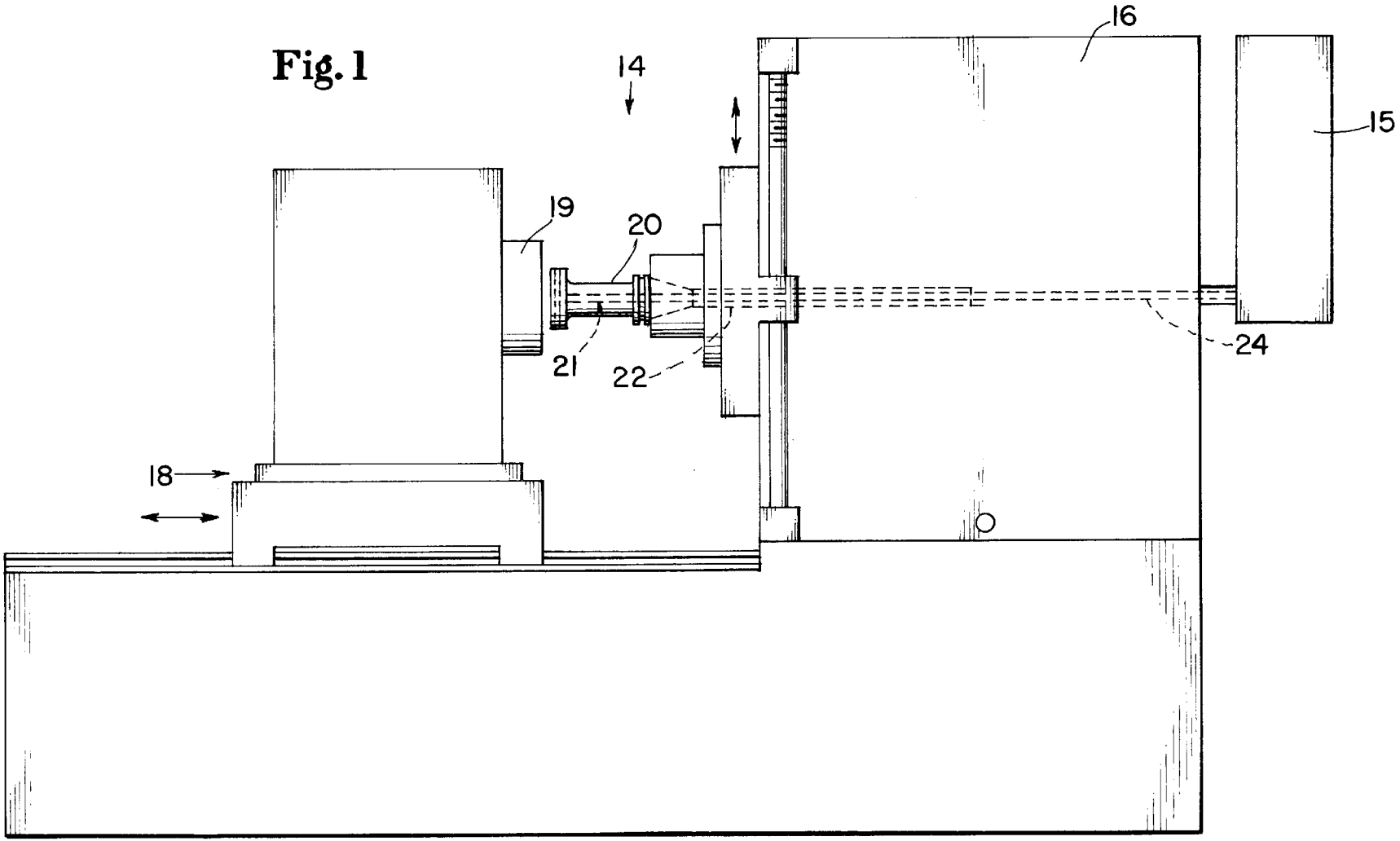
FIG. 1 is a schematic elevational view of a machine spindle showing through spindle fluid communication between a coolant fluid supply and the tool which is used in machine operations for working a workpiece.

Referring now to the drawing figures in detail, wherein like numerals indicate the same elements throughout the views, FIG. 1 illustrates a preferred embodiment of a quickly changeable grinding tool 20 which is to be operated at relatively high speeds and adapted for use with an automatic machine tool changing system or station 16. It is contemplated that in use, grinding tool 20 will be rotated at varying speeds by a power source such as is commonly associated with a machine spindle (e.g., 22).

As shown in FIG. 1, working area 14 typically comprises a machine station 16 having a spindle 22, and a workhead 18 having a workpiece 19 attached thereto using fixtures and techniques known in the industry. In operation, the tool 20 and workpiece 19 are generally rotated or moved respective to one another so the tool 20 is brought into contact with workpiece 19.

Figure 2:
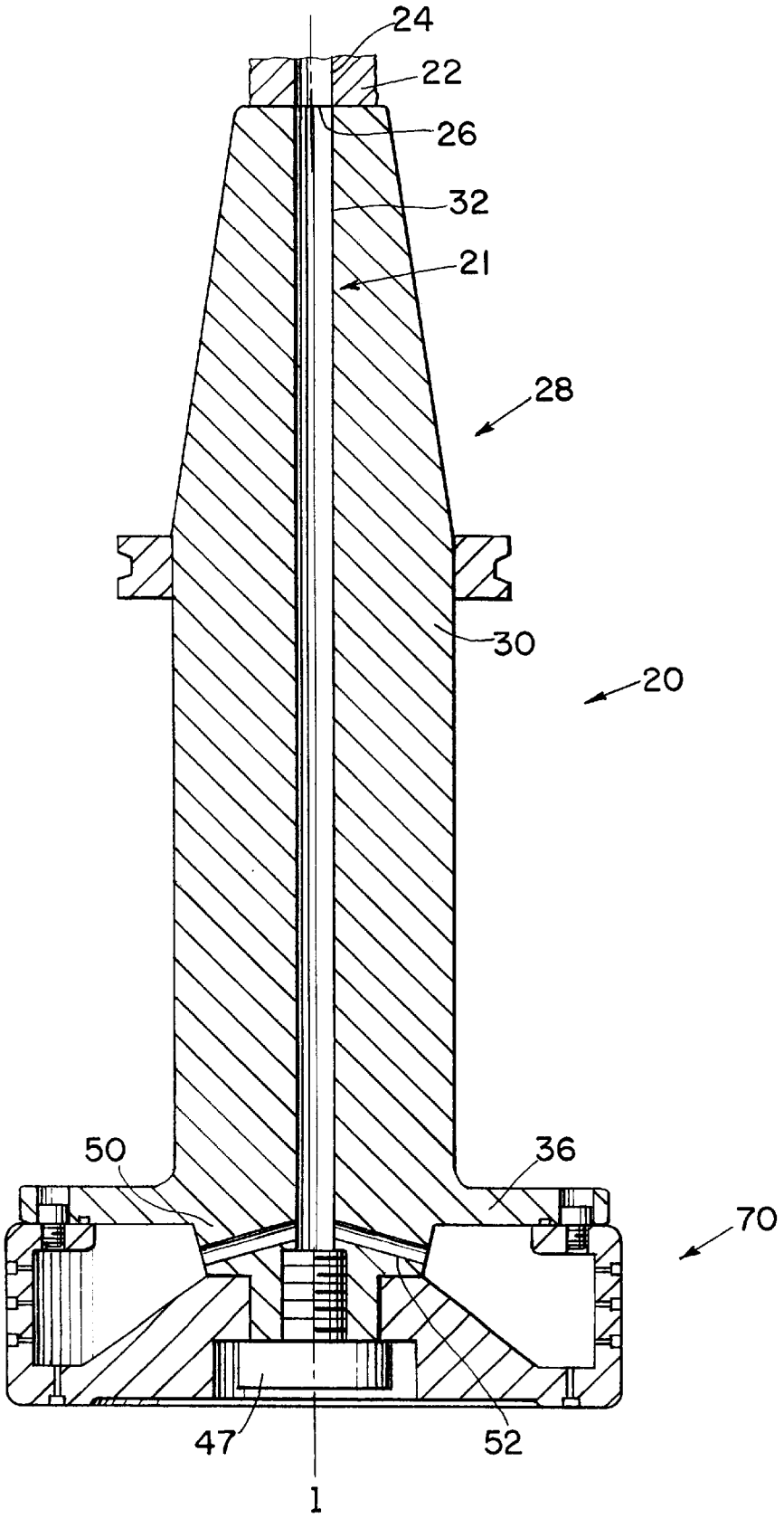
FIG. 2 is a vertical sectional view of the tool made in accordance with the present invention and illustrating a preferred arrangement of the spindle, the tool holder and the superabrasive grinding wheel.

Fluid supply 15 generally provides a source of pressured coolant fluid to be routed though the spindle 22 (via spindle passageway 24) and though tool 20 (via fluid distribution passageway 21) to the grinding surface 78 on the grinding wheel 70, as best seen in FIG. 2. The spindle passage 24 has a proximal end which preferably automatically sealingly interfaces with the tool 20 and fluid distribution passageway 21 at the tool/spindle interface 26. This seal might be provided in a variety of structural arrangements including O-ring seals and the like, and its exact structure may vary among particular applications. Fluid communication is thereby established and maintained between the spindle passageway 24 and fluid distribution passageway 21 when grinding tool 20 is engaged and held in place by spindle 22 using various techniques known in the industry. It should be noted that when tool 20 is not engaged with spindle 22, mechanisms, such as shut off valves, known in the industry are used to terminate the flow of coolant fluid adjacent to the end of spindle passage 24.

The present invention is preferably used with an automatic machine tool changing station (not shown) which can quickly and easily receive and secure one of a plurality of tools for various operations (i.e., rotating, vibrating or oscillating), although the tool could also be utilized in conventional applications and dedicated operations as well. Automatic machine tool changer stations typically have a synchronized system for quickly and easily interchanging and utilizing multiple grinding or cutting tools at one machine station 16, and thereby, can give a machine station 16 greater utility, (i.e., they are not dedicated to a single operation or use of a single type of tool). Any configuration or device for engaging or connecting (i.e., clamping onto or otherwise securing) a tool 20 to spindle 22, such as a collet or a mandrel devices known in the industry, can be used, so long as coolant fluid can be provided to the tool adjacent the spindle/tool interface 26 while the tool 20 is in use, and the means for engaging the tool can quickly interchange tools and establish fluid communication between the spindle passage 24 and the fluid distribution passageways 21 at tool/spindle interface 26 without a need for separately hooking up hydraulic lines or other fluid connections.

Referring now to FIG. 2, grinding tool 20 preferably comprises a tool holder 28 and a grinding wheel 70. Tool holder 28 is further illustrated as including a shank 30, a flange 36, a fluid supply disc 50, and a pilot 60, each of which will be discussed in greater detail herein. Tool holder 28 is also illustrated as having a longitudinal axis, as denoted by "l". Preferably, formed within the longitudinal length of tool 20 is supply tube 32, which is oriented such that the tool 20 and tube 32 are coaxial. This orientation of the tool 20 and tube 32 is preferred so that interchanging tools made in accordance herewith in spindle 22 (i.e., securing the tool 20 in place and establishing fluid communication between the spindle passage 24 and the fluid distribution passageway 21) can be accomplished quickly and easily, and to preserve balance in the tool so that eccentricities which could cause vibrations of tool 20 during use are held to a minimum.

Although the actual dimensions of tube 32 will vary depending on the particular application and intended use of tool 20, in a preferred embodiment of a superabrasive grinding wheel, supply tube 32 has a diameter from about 0.25" (0.65 cm) to about 0.50" (1.3 cm), and preferably about 0.37" (0.95 cm).

Figure 3:
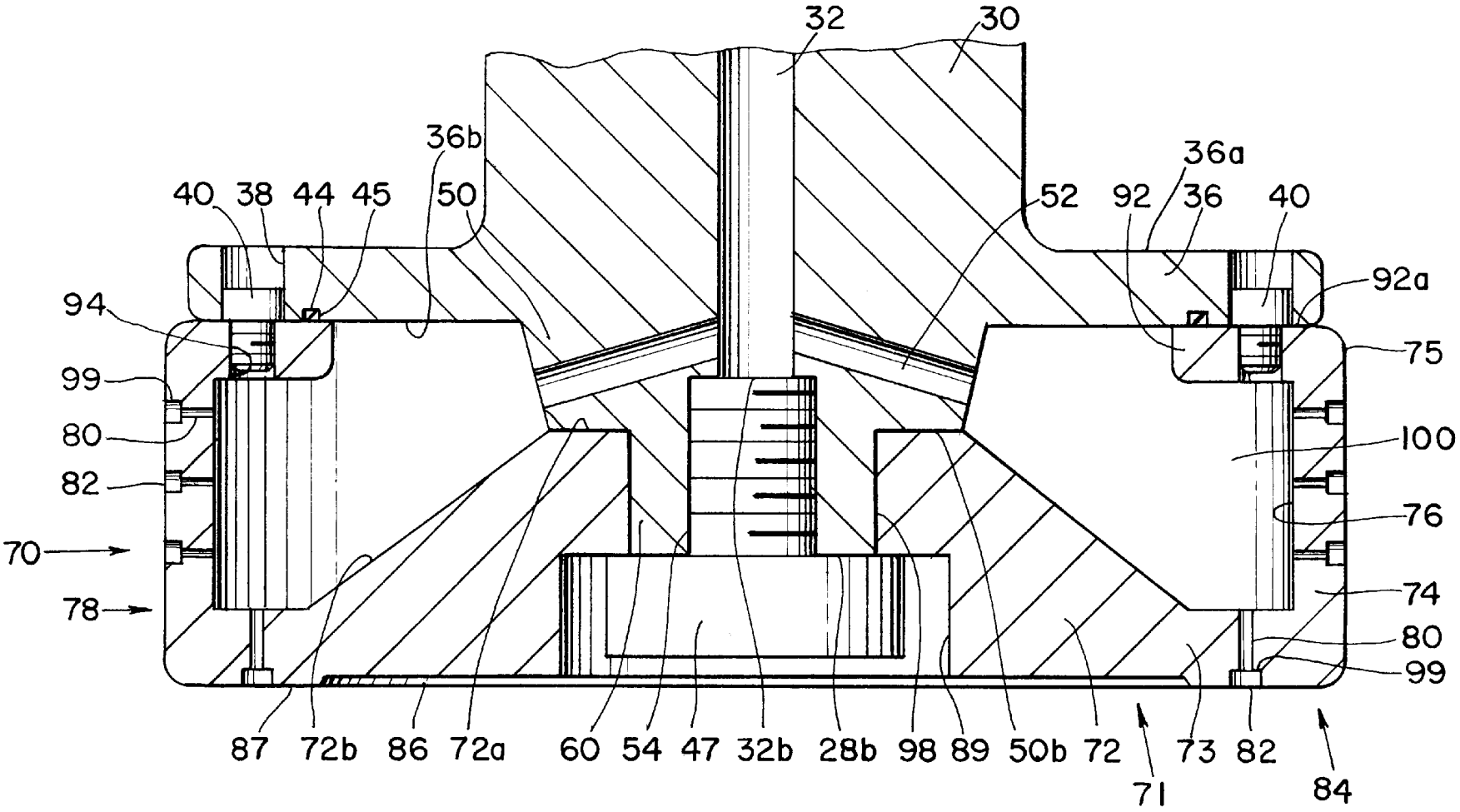
FIG. 3 is an enlarged partial sectional view of the lower portion of the tool of FIG. 2, illustrating details of the grinding wheel.

As illustrated in FIGS. 2 and 3, tool holder 28 also comprises a flange 36 positioned adjacent the distal end of shank 30 and featuring a generally cylindrical or disc shape having a top face 36(*a*) and bottom face 36(*b*). To facilitate manufacture and assembly, flange 36 can be secured to grinding wheel 70 by any of a number of common attachment means known in the industry, such as by a plurality of machine bolts 40 passing though bores 38 and into aligned tapped openings 94 in wheel 70. In one embodiment where wheel 70 has an outer diameter of approximately 6.0" (15.25 cm), five (5) equally spaced bores 38 and five corresponding tapped holes 94 can be used to adequately maintain attachment of the grinding wheel 70 to the flange 36 at typical operating wheel speeds ranging from about 2000 to about 40,000 feet/minute (610 to 12,200 meter/minute).

A seal is provided between flange 36 and wheel 70, such as by a groove 44 which is formed in and extends completely around bottom face 36(*b*), and a seal or O-ring 45 or the like. Seal 45 might preferably have a slightly larger outer diameter and slightly smaller inner diameter than groove 44 in order to facilitate formation of a reliable fluid tight seal between the bottom face 36*b* of flange 36 and the upper rim face 92*a* of grinding wheel 70. As will be appreciated, this seal prevents fluids under pressure from leaking out of the plenum 100 between flange 36 and grinding wheel 70, and helps maintain a relatively constant rate of pressure throughout the fluid distribution passageway 21.

As illustrated best in FIG. 3, positioned on tool holder 28 below flange 36 on tool 20 is a fluid supply disc 50 which can be integrally formed with the shank 30 and flange 36 as part of tool holder 28, or can be attached to the bottom face 36(*b*) by having the respective faces connected (e.g., welded). In the featured embodiment, the outer edge 50*a* of disc 50 tapers inwardly and, consequently, the diameter of disc 50 narrows as it extends longitudinally away from flange 36. In a preferred embodiment, disc 50 has a diameter of about 2.5" (6.35 cm) at the upper portion, and its diameter narrows to about 2.13" (5.4 cm) at the bottom portion, and the outer edge 50*a* is formed at an angle of about 105° respective to bottom face 36(*b*).

As previously discussed, tool holder 28 comprises a supply tube 32 extending longitudinally within at least a portion of the length of tool holder 28. Adjacent distal end 32*b*of supply tube 32, the fluid distribution passageway 21 preferably splits into a plurality branch supply passages 52 that provide fluid communication between the supply tube 32 and an annular space or plenum 100 within grinding wheel 70. These branch supply passages are also preferably sized, placed and oriented appropriately so that tool 20 remains balanced during use. The number and size of passages 52 required to deliver an adequate volume of coolant fluid through tool 20 depends on a variety of variables including the diameter of wheel 70 and the pressure at which coolant fluid must be delivered through opening 82 to achieve the velocity to remove plasticized particles from grinding surface 78. For example, as the diameter of wheel 70 increases, the number of passages 52 needed to properly supply fluid to the grinding wheel 70 with coolant fluid also tends to increase. Passages 52 can be formed in tool holder 28, as shown best in FIG. 3, such that they feature upward and inward orientations so that fluid communication is established between supply tube 32 and the plenum 100. In an exemplary embodiment when grinding wheel 70 has a diameter of about 6.0" (15.25 cm), five (5) supply passages 52 are spaced around tool holder 28, each having a diameter of from about 0.15" (0.38 cm) to about 0.25" (0.65 cm) and most preferably of about 0.187" (0.47 cm).

A recess 54 formed in the bottom face 28*b* of tool holder 28 is sized and configured to receive a fastening means 47, such as a pin, screw, or bolt, which attaches the grinding wheel 70 to the tool holder 28. Additionally, fastening means 47 can also serve to effectively plug or reroute fluid in the distal end 32*b* of supply tube 32. Alteratively, a plugging device separate from the fastening means 47 can be used independent of, or in conjunction with, fastening means 47 to plug the distal end 32*b* of the supply passage 32 within tool 20. It is also contemplated that in addition to, or in lieu of recess 54, additional recesses similar to recess 54 may be provided to receive additional fastening means 47.

Positioned longitudinally below disc 50 on tool holder 28 is a pilot 60 which can be sized and configured to be substantially non-rotatably received in corresponding pilot opening 98. In a preferred embodiment, pilot 60 has a substantially cylindrical shape, however, it is contemplated that pilot 60 can be formed in geometric or other non-cylindrical shape structures which would provide a keyed or interlocking mechanism via the fitting of pilot 60 in pilot opening 98 that would enhance the locking relationship between wheel 70 and tool holder 28.

It is noted that the various components of the tool holder 28 can be formed as separate elements and connected using techniques known in the industry. It may also be appreciated in some applications to integrally form several or all of the components (shank 30, flange 36, fluid supply disc 50 and pilot 60) using casting, forging or machining techniques known in the industry.

Similarly, grinding wheel 70 can be secured to the distal end of tool holder 28 as described above, or formed integrally therewith, although it is believed that integral formation would be less preferred as probably more difficult and expensive. In the embodiment shown in FIG. 3, wheel 70 comprises a base 71 having a disc portion 73, a raised center portion 72 having a top surface 72*a,* and a ring portion 74 having an inner face 76, radial face 75, and a rim portion 92 extending inwardly at an angle of about 90° respective to the ring portion 74.

The wheel 70 can be formed in a variety of ways, such as by investment casting or machining a billet to achieve the desired configuration and shape. Investment casting allows for quick repetitive manufacture of multiple grinding wheels 70, and can eliminate the need for boring operations often required to add counterbores and other details. Wheel 70 can be formed from a variety of standard materials available in the industry that maintain structural integrity in the desired configuration at rotational speeds from about 2,000 to about 40,000 feet/minute (610 to 12,200 meters/minute). Illustrative examples of materials which might be employed as grinding wheel 70 include medium carbon steel, aluminum, cast iron, titanium, or other metal alloys.

Raised center portion 72 is formed so that side edges 72*b* preferably tappers inwardly at an angle of about 30° to about 60°, and preferably 38°, with respect to the axial face 84 of disc portion 73. A top surface 72*a* is preferably formed on the top of raised center portion 72 so the bottom face 50*b* of fluid supply disc 50 can rest thereon when wheel 70 and tool holder 28 are fitted together. For enhanced fit, it is also preferred that surface 72*a* have a diameter equal to or greater than the diameter of bottom face 50*b*. Formed on the axial face 84 of wheel 70 is a shallow concave recess 86 which, provides a lip 87 around the periphery of the axial face 84 that can be used as additional area for grinding surface 78. Recess 86 will preferably have a diameter about the same as the largest diameter of the central raised portion 72, and in one embodiment, recess 86 has a depth of about 0.03" (0.08 cm).

Formed between ring portion 74 and raised center portion 72 is plenum 100 which is in fluid communication with the branch supply passages 52 and the plurality of guide channels 80. As will be understood, coolant flows into plenum 100 from central supply tube 32, and then to the guide channels 80. The plenum 100 can also advantageously serve as a heat sink when filled with coolant fluid, such that the coolant fluid dissipates the heat energy from the body of grinding wheel 70. Forming a grinding wheel 70 with a plenum 100 within also makes manufacture of wheels 70 easier and less expensive (e.g., the wheel is easier to cast, less material is used), and the resulting hollow spaces facilitate assembly of the grinding wheel 70 and tool holder 28.

Pressure within the fluid distribution passageway 21 must be maintained or controlled so that coolant fluid is delivered to the openings 82A–C at a desired velocity. The structure (i.e., size and configuration) of the entire fluid distribution passageway 21 can be customized to achieve this result.

Formed in the raised center portion 72 is a pilot opening 98 which extends through wheel 70. The pilot opening 98 is sized and configured to receive pilot 60 therein. Preferably, immediately below pilot opening 98 is a countersink opening 89 having a diameter greater than the diameter of the pilot opening 98 that is sized and configured so the head portion of fastening means 47 is at least flush, and preferably concealed within the recess 86 of axial face 84.

Figure 4:
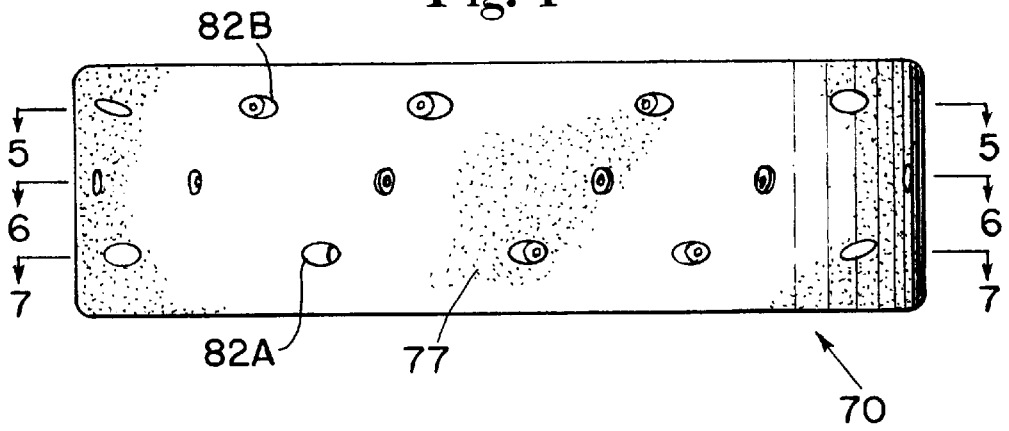
FIG. 4 is an elevational view of one embodiment of the superabrasive grinding wheel of FIG. 2 illustrating various orientations of the fluid openings.

The grinding surface 78 of wheel 70 comprises layers of abrasive grit that can be embedded in or plated on a portion of the radial face 75, as shown in FIG. 4, or on a portion of the axial face 84 or combinations thereof. Abrasive grits which are usable on the grinding surface 78 superabrasive grinding should be usable to conduct superabrasive grinding operations at speeds varying from about 2000 to about 40,000 feet per minute (610 to 12,200 meter/minute). Illustrative examples of materials which might be used as abrasive grit include natural diamonds, synthetic materials including polycrystaline diamonds (PCD), manocrystaline diamonds (MCD), cubic boron nitride (CBN), or combinations of these materials. A grinding wheel 70 with these types of grinding grits can be used to grind materials such as fiber reinforced plastics, glass, allow metals, ceramics, rocks, carbides, and other hardened materials.

Individual openings 82A–C and guide channels 80 can have varied diameters depending on the viscosity of the cooling fluids used and the speed of wheel 70 to control the volume and velocity of coolant fluid being delivered through fluid distribution passageway 21 to the grinding area. It is necessary that a sufficient amount of coolant fluid be directed toward the grinding area to reduce or dissipate heat and friction generated by the interacting grinding surface 78 and the workpiece. As can be appreciated, increasing the diameter of guide channels 80 and openings 82A–C reduces flow resistance and increases flow volume, however, results in a decrease in fluid velocity which can reduce the efficiency and effectiveness of the cleaning (i.e., washing away cut particles and removal of plated particles) of the grinding surface 78.

As illustrated in FIGS. 2–7, counterbores 99 are provided on the radial face 75 adjacent to openings 82A–C have a diameter greater than the diameter of either openings 82A–C or guide channels 80. It should be noted that counterbores 99 are preferably formed with slightly larger diameters in order to facilitate forming the guide channels 80. If grinding wheel 70 can be formed from a mold cast with integral counterbores, the need for counterbores 99 is eliminated. In one embodiment, counterbores 99 on the radial face 75 have a diameter of about 0.25" (0.64 cm), and openings 82A–C and the guide channels 80 have a diameter of about 0.03" (0.08 cm).

Guide channels 80 can be formed completely through ring portion 74, disc portion 73, or combinations thereof, and each terminates in close proximity to grinding surface 78 with fluid delivery openings 82A–C. As shown in FIGS. 4–7, the guide channels 80 and openings 82A, 82B and 82C can be selectively sized, oriented and configured for assisting in optimal cleaning operations (i.e., the top row of FIG. 4 designated as "r1" and FIG. 5), for assisting in optimal cooling operations (i.e., the bottom row of FIG. 4 designated as "r3" and FIG. 7), or perpendicular to the radial face 75, (i.e., the middle row of FIG. 4 designated as "r2" and FIG. 6).

Figure 7:
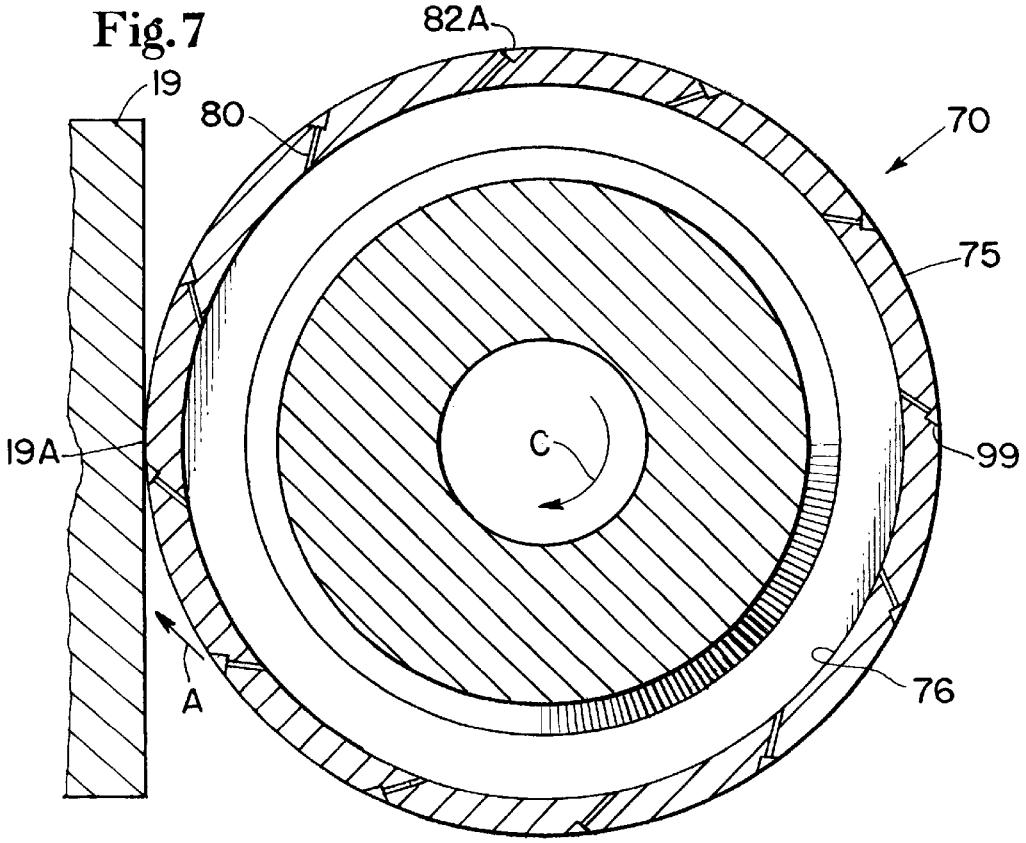
FIG. 7 is a cross sectional view of the grinding wheel of FIG. 4 taken along line 7—7 thereof, and further illustrating the grinding wheel engaged with the workpiece at the workpiece/grinding tool interface.

For enhanced cooling operations, guide channels 80 and opening 82A shown in the middle row "r2" of FIG. 4 and FIG. 7 are each acutely angularly oriented at an angle of less than 90°, preferably at an angle from about 30° to about 70°, and more preferably at 45°, with respect to radial face 75. Particularly, the rotation of grinding wheel 70 in the clockwise direction, as shown by direction arrow "c", and this "forward" angular orientation of the openings 82A and guide channels 80 assists in focusing and directing a greater volume of the coolant fluid toward the grinding area or grinding workpiece/grinding tool interface 19A in use (see direction arrow "A" in FIG. 7), which assists in providing a thin fluid film between the grinding wheel 70 and the workpiece for reducing friction between the grinding wheel 70 and workpiece, and in removing or dissipating the heat energy generated.

Figure 5:
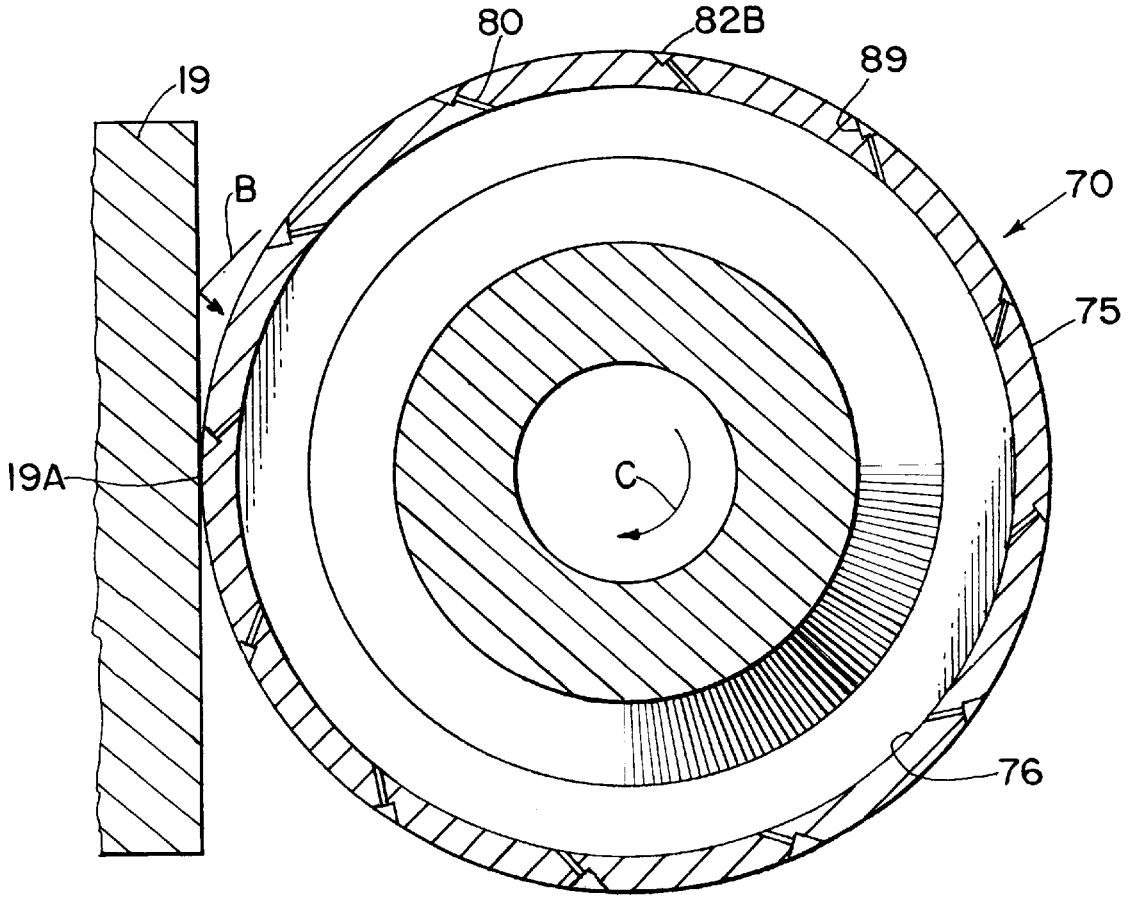
FIG. 5 is a vertical cross sectional view of the grinding wheel of FIG. 4 taken along line 5—5 thereof, and further illustrating the grinding wheel engaged with the workpiece at the workpiece/grinding tool interface.

For enhanced cleaning operations, guide channels 80 and openings 82B can be obtusely angularly oriented, as shown in the bottom row "r3" of FIG. 4 and FIG. 5, to direct coolant fluid rearwardly and back toward the grinding area or workpiece/grinding tool interface 19A to impinge the workpiece after that portion of the wheel 70 has completed its pass over the workpiece in clockwise direction of rotation, as shown by arrow "c" in FIG. 7. This "rearward" angular orientation directs coolant fluid toward the workpiece such that, after the coolant fluid hits the workpiece, it "splashes back" at relatively high velocity onto trailing portions of the wheel 70, thereby assisting in washing away recently ground particles or removing loaded particles on the grinding surface 78 (see direction arrow "B" in FIG. 5). This "splash back" effect can be achieved when guide channels 80 and openings 82B are oriented at an angle greater than 90°, preferably from about 110° to about 150°, or at 135°, with respect to the radial face 75.

Figure 6:
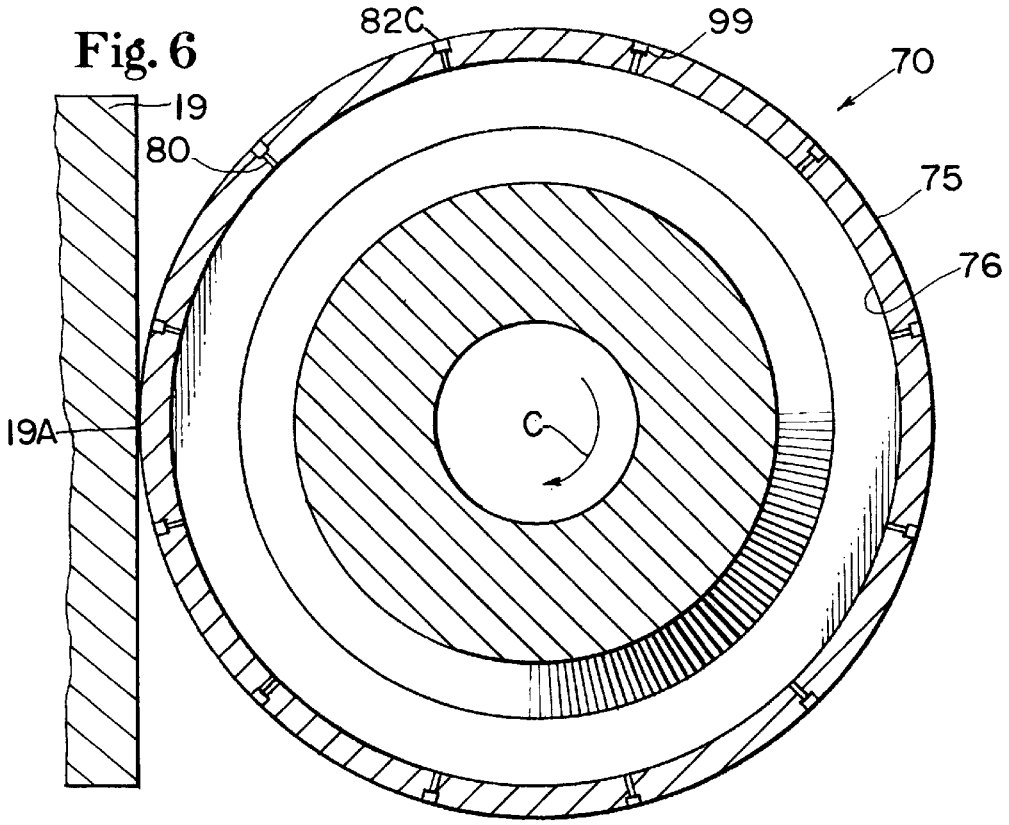
FIG. 6 is a cross sectional view of the grinding wheel of FIG. 4 taken along line 6—6 thereof, and further illustrating the grinding wheel engaged with the workpiece at the workpiece/grinding tool interface.

FIG. 4 and the middle row of opening 82 in FIG. 6 shows guide channels 80 and openings 82C at an angle of about 90° with respect to the radial face 75.

As shown in FIGS. 4–7 for illustrative purposes only, thirty-six (36) openings 82A, 82B and 82C and their respective guide channels 80 might preferably be provided in the radial face 75 and ring portion 74, each being substantially spaced apart at about 10° intervals from each other and in a staggered configuration about the radial face 75 of wheel 70. As discussed before, all the openings 82B and channels 80 in the top row "r1", as shown in FIG. 5, preferably have the same orientation, and the openings 82C and channels 80 in the middle row "r2" in FIG. 6 and the bottom row "r3" in FIG. 7 similarly have uniform, but distinctive, orientations. It is contemplated that a grinding wheel 70 can comprise one or more rows of openings 82A with each of the openings 82A, 82B and 82C and respective guide channels 80 having a different size and orientation to optimize cleaning and cooling operations as appropriate.

Figure 8:
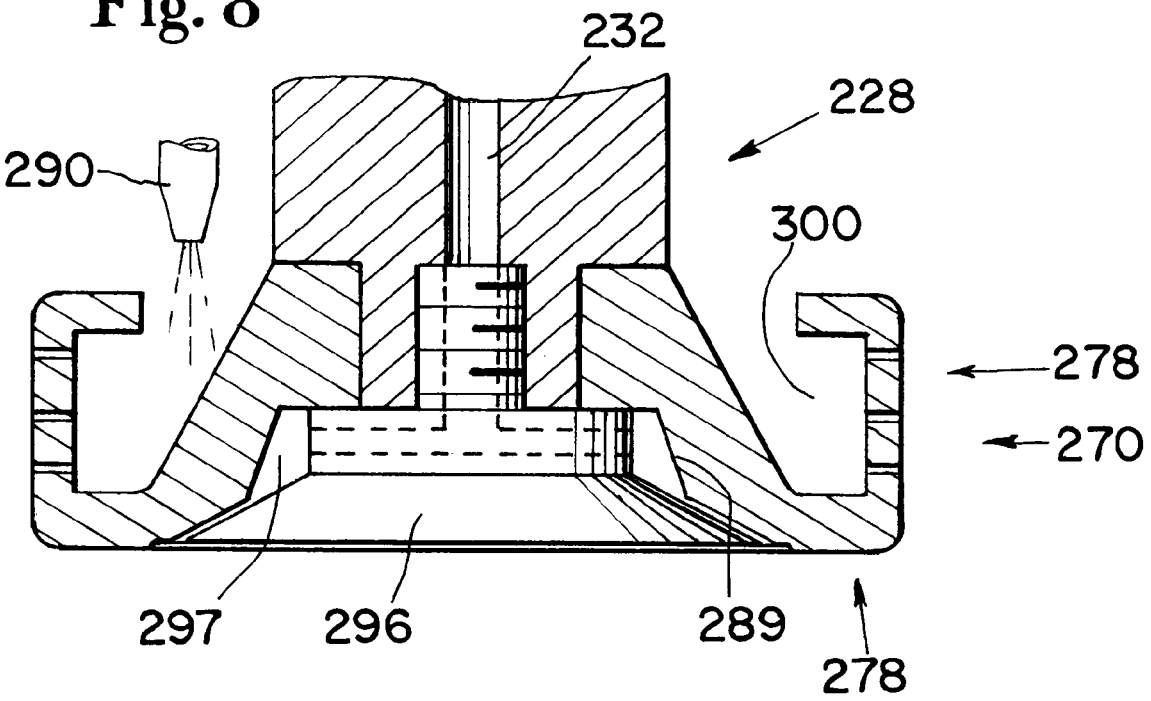
FIG. 8. is a partial vertical longitudinal cross sectional view of an alternative embodiment of a superabrasive grinding wheel made in accordance with the present invention including a diffuser plate.

As shown in FIG. 8, an alternative embodiment of grinding wheel 270 is illustrated as having a modified enlarged opening 289 formed in the base 271 that is sized and configured to receive a coolant diffuser plate 296 and allow for a radially oriented fluid delivery space (e.g., 297) to be formed between diffuser 296 and opening 289. In this alternative embodiment, tool holder 228 is formed and configured so that coolant fluid can also be delivered under predetermined pressure in a radially outward direction and in close proximity to the grinding surface 278 and a workpiece through the fluid delivery space 297. This configuration allows for a greater volume of coolant fluid to be delivered directly to grinding area for cooling. Since fluid communication is to be established between supply tube 232 and space 297, it is preferred that supply tube 232 not be completely plugged, but that coolant fluid flow directly from supply tube 232 to space 297. It is contemplated that coolant fluids can also be delivered to the plenum 300 of grinding wheel 270 via additional fluid supply passages (e.g., similar to 52 shown in FIGS. 2 and 3) formed in either tool holder 228 or wheel 270, or combinations thereof, or via external fluid jet sprays 290 through openings in wheel 270, flange 236, or combinations thereof.

Figure 9:
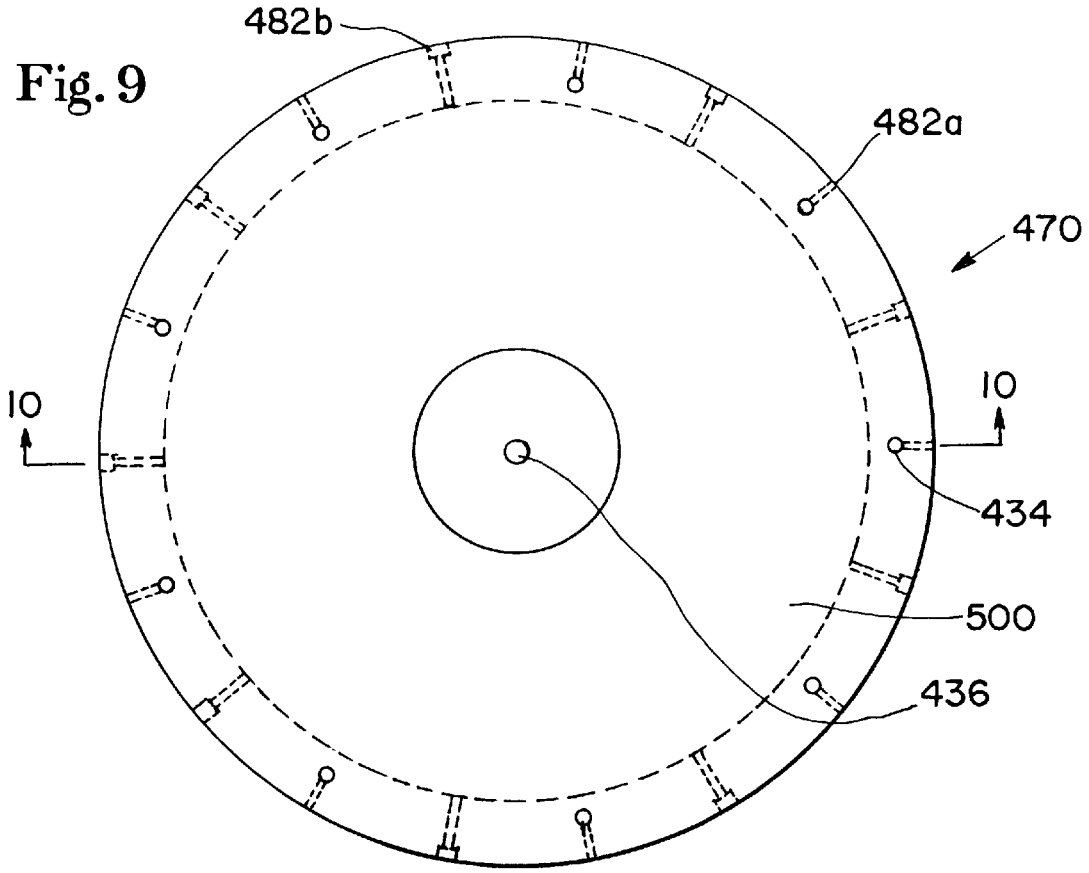
FIG. 9 is a top plan view of an alternative embodiment of a superabrasive grinding wheel made in accordance with the present invention including a dual source of fluid delivery to the workpiece.
Figure 10:
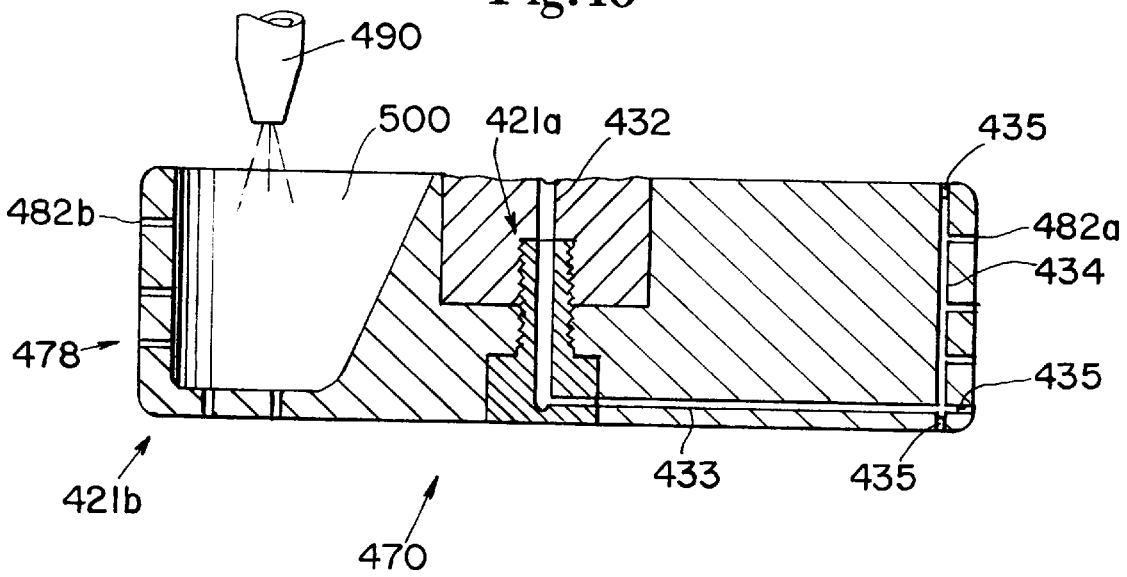
FIG. 10 is a cross sectional view of the grinding wheel of FIG. 9 taken along line 10—10 thereof.

FIGS. 9 and 10 illustrate yet another alternative embodiment of the present invention having a dual coolant delivery system for cleaning and cooling operations respectively. Coolant fluid is routed to the grinding surfaces 478 via separate and independent systems so that optimal cleaning and cooling results can be achieved. It is contemplated that the separate fluid delivery systems would typically operate at different pressures as a result of the size and configuration of the fluid distribution passageway set up through the spindle (e.g., 22), or as a result of an additional coolant delivery system 423 (i.e., external and independent from through spindle and tool or coaxial with fluid distribution passageway 421*a*).

Since higher pressures are generally desired for cleaning operations, coolant fluid for the cleaning operation would preferably be delivered via an internal (e.g., thru-spindle) set-up as discussed above, whereby coolant fluid is directed from supply tube 432 to one or more cross channels 433 and supply channels 434, which can be conveniently formed in wheel 470 by a boring operation and then plugged (e.g., with plugs 435) on the outer face of wheel 470. It is important that channels 433 and 434 be oriented, sized, and/or configured to deliver coolant fluid through fluid distribution passageway 421*a* and openings at a desired velocity, which are for cleaning operations as discussed above and shown in FIG. 5. For cooling operations, it is more important for an increased volume of coolant fluid to be delivered to the grinding area, as opposed to delivery of cooling fluids at increased pressures or velocity. FIG. 10 illustrates a separate fluid delivery system 423 for cooling that can comprise a plenum 500 for receiving coolant fluid from an external source 490, such as jet spray, or from a separate integrally formed second fluid distribution passageway.

Referring back to FIG. 1, in use, coolant fluid is directed under pressure from a fluid source or supply 15 (e.g., from about 200 psi to about 2000 psi ($2.9\times10^3$ and $2\times10^4$ kP)), into the spindle passage 24, which is in fluid communication with fluid distribution passageway 21 when tool 20 in engaged with spindle 22. As discussed in detail above, fluid distribution passageway 21 can preferably comprise the combination of supply tube 32, branch supply passages 52, plenum 100, and guide channels 82A–C. Coolant fluids used with the present invention should be substantially immune to the negative effects from pressures ranging from about 200 psi ($2.9\times10^3$ kP) and extending upwards to pressures in excess of 2000 psi ($2\times10^4$ kP). For example, water based coolants with between about 5% and 10% emulsified oils, (i.e., lower oil content coolants) can be used. If pressures in the supply source 15, spindle passage 24 or fluid distribution passageway 21 reach 2000 psi ($2\times10^4$ kP) or above, emulsified oils become unstable and therefore are not preferred. At these high pressure, it is preferred that pure coolant fluid oils be utilized as the coolant fluids. As is known in the industry, pure coolant fluid oils are also often preferred for providing a better finish on a workpiece.

Coolant fluids are directed into and routed through the spindle passage 24 and the supply tube 32, and branch supply passages 52, and into the plenum 100. Coolant fluid then flows into the plurality of guide channels 80 and out of the wheel 70 through openings 82A–C. Pressure throughout the fluid distribution passageway 21 is preferably maintained at a substantially constant level. As described above, the coolant fluid leaving the wheel 70 through openings 82A–C serves to optimally assist in providing a thin film to remove or dissipate heat energy (see, e.g., 82A in FIGS. 4 and 7), or to assist in washing away recently ground particles, and/or remove plasticized particles on the grinding surface 78 (see, e.g., 82B in FIGS. 4 and 5). Dependant on the configuration of the fluid distribution passageway 21, the volume of fluid delivered through the openings 82 is preferably between about 6 and 30 gallons per minute (22.75 to 113.5 liters per minute). When the rotation of grinding wheel 70 brings openings 82A near engagement with the workpiece at a grinding surface/workpiece interface, fluid is routed through guide channels 80, exits openings 82A, and is directed toward the interface area. Directing or routing fluid as such enhances providing a thin film between the grinding wheel 70 and the workpiece, that in turn, can reduce friction therebetween. As the rotation of grinding wheel 70 moves openings 82B away from the grinding surface/workpiece interface, fluid exiting openings 82B is directed back toward the workpiece such that fluid hits the workpiece and splashes back at a relatively high velocity (e.g., up to 2000 psi or $2.0.10^4$ KPa) into the trailing portion of the wheel 70. Fluid directed as such assists in washing away recently ground particles or removing loaded particles on the grinding surface 78.

Shown in FIG. 10, coolant fluid is routed through a fluid distribution passageway like the one shown as 421 and flows out of wheel 470 through openings 482*a* sized, oriented and configured for optimal cleaning operations, into the grinding area. Additionally, coolant fluid flows through a second fluid distribution passageway 421*b* (e.g., plenum 500 and guide channels 482*b*) and out of wheel 470 through openings 482*b*sized, oriented, and configured for optimal cooling operations, into the grinding area.

Having shown and described the preferred embodiments of the present invention in detail, it will be apparent that modifications and variations by one of ordinary skill in the art are possible without departing from the scope of the present invention defined in the appended claims. Several potential modifications have been mentioned and others will be apparent to those skilled in the art. Accordingly, the scope of the present invention should be considered in terms of the following claims and is understood not to be limited to the details of structure and operation shown and described in the specification and drawings.

We claim:

1. An improved grinding tool for working a workpiece at a workpiece/grinding tool interface, and for use with a machine spindle having a securement device and a source of pressurized fluid, said grinding tool comprising:

a) a tool holder adapted for connecting with the securement device for attaching and securing said tool holder to said machine spindle;

b) an interface configured for placing said tool in fluid communication with the source of pressurized fluid; and c) a tool body having a grinding surface with a radial face and a fluid distribution system, said fluid distribution system comprising a first and a second set of fluid delivery openings formed in close proximity to said grinding surface for directing fluid toward the workpiece/grinding tool interface at a controlled rate, said first and second set each having an angular orientation relative to said radial face and the first set of fluid delivery openings are angularly oriented relative to said radial face different from the angular orientation of said second set of fluid delivery openings.

2. The grinding tool of claim 1, wherein said first set of fluid delivery openings are rearwardly oriented relative to said radial face for removing plasticized particles from said grinding surface.

3. The grinding tool of claim 2, wherein said first set of fluid delivery openings are obtusely angled relative to said radial face.

4. The grinding tool of claim 3, wherein said first set of fluid delivery openings are oriented at an angle from about 110 to about 150 degrees respective to said radial face.

5. The grinding tool of claim. 4, wherein said first set of fluid delivery openings are oriented at an angle about 135 degrees with respect to said radial face.

6. The grinding tool of claim 2, wherein said first set of fluid delivery openings are acutely angled relative to said radial face.

7. The grinding tool of claim 6, wherein said first set of fluid delivery openings are oriented at an angle from about 30 to about 70 degrees respective to said radial face.

8. The grinding tool of claim 7, wherein said first set of fluid delivery openings are oriented at an angle about 45 degrees with respect to said radial face.

9. The grinding tool of claim 1, wherein said second set of fluid delivery openings are forwardly oriented relative to said radial face for lubricating said grinding surface and the workpiece.

10. The grinding tool of claim 9, wherein said second set of fluid delivery openings are obtusely angled relative to said radial face.

11. The grinding tool of claim 10, wherein said second set of fluid delivery openings are oriented at an angle from about 110 to about 150 degrees respective to said radial face.

12. The grinding tool of claim 11, wherein said second set of fluid delivery openings are oriented at an angle about 135 degrees with respect to said radial face.

13. The grinding tool of claim 9, wherein said second set of fluid delivery openings are acutely angled relative to said radial face.

14. The grinding tool of claim 13, wherein said second set of fluid delivery openings are oriented at an angle from about 30 to about 70 degrees respective to said radial face.

15. The grinding tool of claim 14, wherein said second set of fluid delivery openings are oriented at an angle about 45 degrees with respect to said radial face.

16. The grinding tool of claim 15, wherein said second set of fluid delivery opening is oriented at an angle 135 degrees respective to said radial face.

17. The grinding tool of claim 1, wherein said grinding wheel comprises an axial face, said axial face comprising an opening in fluid communication with said source of pressurized fluid.

18. The tool of claim 1 wherein said first set of fluid delivery openings are angularly oriented perpendicular to said radial face.

19. A method for delivering fluid from a source of pressurized fluid to an area adjacent a workpiece/grinding tool interface during machining operations on a workpiece, said method comprising the steps of:

a) providing a grinding wheel having a grinding surface and a fluid delivery system, and a first and second set of fluid delivery opening in close proximity to said grinding surface, said first and second set each having an angular orientation relative to said radial face and the first set of fluid delivery openings are angularly oriented relative to said radial face different from the angular orientation of said second set of fluid delivery openings, said fluid delivery system configured for selectively establishing fluid communication between said first and second set of fluid delivery opening and the source of pressurized fluid;

b) machining the workpiece with said grinding surface at the workpiece/grinding tool interface; and c) directing fluid through said first set of fluid delivery openings backwardly toward said area adjacent the workpiece/grinding tool interface at a controlled rate.

20. The method of claim 19, comprising the step of removing recently cut particles from said grinding surface.

21. The method of claim 20, comprising the step of removing recently cut particles before plasticizing.

22. The method of claim 19, comprising the step of delivering fluid through said first and second set of openings at a fluid pressure from about 200 to about 2000 pounds per square inch.

23. The method of claim 19, comprising the step of rotating said grinding wheel at a speed from about 2000 to about 40,000 feet per minute.

24. The method of claim 19, comprising the step of directing fluid through said second set of fluid delivery openings forwardly toward said area adjacent the workpiece/grinding tool interface.

25. The method of claim 24, comprising the step of lubricating said workpiece/grinding tool interface.

26. The method of claim 19, comprising the step of establishing fluid communication between said first and second set of fluid delivery openings and said source of pressurized fluid.

27. An improved grinding tool for working a workpiece at a workpiece/grinding tool interface, and for use with a machine spindle having a securement device and a source of pressurized fluid, said grinding tool comprising:

a) a tool holder adapted for connecting with the securement device for attaching and securing said tool holder to said machine spindle;

b) an interface configured for placing said tool in fluid communication with the source of pressurized fluid; and c) a tool body having a grinding surface with a radial face and a fluid distribution system, said fluid distribution system comprising a first set and a second set of fluid delivery openings, wherein said first set of fluid delivery openings are rearwardly oriented relative to said radial face for removing plasticized particles from said grinding surface and said second set of fluid delivery openings are forwardly oriented relative to said radial face for lubricating said grinding surface and the workpiece.

28. The tool of claim 27, further comprising a third set of fluid delivery openings have an angular orientation perpendicular relative to said radial face.

* * * * *

UNITED STATES PATENT AND TRADEMARK OFFICE

CERTIFICATE OF CORRECTION

PATENT NO. : 5,993,297
DATED : November 30, 1999
INVENTOR(S) : Gregory A. Hyatt, et al.

It is certified that error appears in the above-identified patent and that said Letters Patent is hereby corrected as shown below:

In claim 19, column 14, line 3, replace "opening" with --openings--.

Signed and Sealed this

Fourth Day of July, 2000

*Attest:*

Q. TODD DICKINSON

*Attesting Officer*

*Director of Patents and Trademarks*